US009163349B2

(12) United States Patent
Classen et al.

(10) Patent No.: US 9,163,349 B2
(45) Date of Patent: Oct. 20, 2015

(54) PUSH-IN METERING SYSTEM FOR DOMESTIC APPLIANCES

(75) Inventors: Egbert Classen, Wertingen (DE); Caroline Heiligenmann, Boeblingen (DE); Helmut Jerg, Giengen (DE)

(73) Assignee: BSH Hausgeraete GmbH, Munich (DE)

( * ) Notice: Subject to any disclaimer, the term of this patent is extended or adjusted under 35 U.S.C. 154(b) by 1607 days.

(21) Appl. No.: 12/084,874

(22) PCT Filed: Dec. 4, 2006

(86) PCT No.: PCT/EP2006/069279

§ 371 (c)(1),
(2), (4) Date: May 9, 2008

(87) PCT Pub. No.: WO2007/074028

PCT Pub. Date: Jul. 5, 2007

(65) Prior Publication Data

US 2009/0266389 A1 Oct. 29, 2009

(30) Foreign Application Priority Data

Dec. 23, 2005 (DE) ..... 10 2005 061 801

(51) Int. Cl.
*D06F 39/02* (2006.01)
*A47L 15/44* (2006.01)

(52) U.S. Cl.
CPC ..... *D06F 39/02* (2013.01); *A47L 15/4463* (2013.01); *D06F 39/026* (2013.01)

(58) Field of Classification Search
CPC ..... D06F 39/02
See application file for complete search history.

(56) References Cited

U.S. PATENT DOCUMENTS

| | | | | |
|---|---|---|---|---|
| 3,756,457 | A * | 9/1973 | Holmes et al. | 222/1 |
| 4,932,227 | A | 6/1990 | Hogrefe | |
| 5,413,259 | A | 5/1995 | Cerruti et al. | |
| 5,550,050 | A | 8/1996 | Holland et al. | |
| 7,789,967 | B2 * | 9/2010 | Classen et al. | 134/18 |
| 2005/0126608 | A1 * | 6/2005 | DeWeerd et al. | 134/56 D |
| 2006/0060214 | A1 | 3/2006 | Rosenbauer | |
| 2007/0144558 | A1 | 6/2007 | Classen et al. | |

FOREIGN PATENT DOCUMENTS

| | | | | |
|---|---|---|---|---|
| DE | 39 03 636 | | 8/1990 | |
| EP | 1 452 636 | | 9/2004 | |
| WO | WO 02/20893 | | 3/2002 | |
| WO | WO02/20893 | A1 * | 3/2002 | D06F 39/02 |
| WO | WO 02/29150 | | 4/2002 | |
| WO | WO02/29150 | A1 * | 4/2002 | D06F 39/02 |
| WO | WO 02/058528 | | 8/2002 | |
| WO | WO 2004/072353 | | 8/2004 | |
| WO | WO2005/058126 | A1 * | 6/2005 | A47L 15/42 |
| WO | WO 2005/073453 | | 8/2005 | |

OTHER PUBLICATIONS

International Search Report PCT/EP2006/069279.

* cited by examiner

*Primary Examiner* — Michael Barr
*Assistant Examiner* — Jason Riggleman
(74) *Attorney, Agent, or Firm* — James E. Howard; Andre Pallapies

(57) ABSTRACT

A domestic appliance having a metering device into which a storage insert containing additive substances can be inserted and by means of which additive substances can be dispensed in metered fashion during a number of cleaning operations. The metering device is distinguished in that it has an interface device for interacting with different storage inserts.

11 Claims, 1 Drawing Sheet

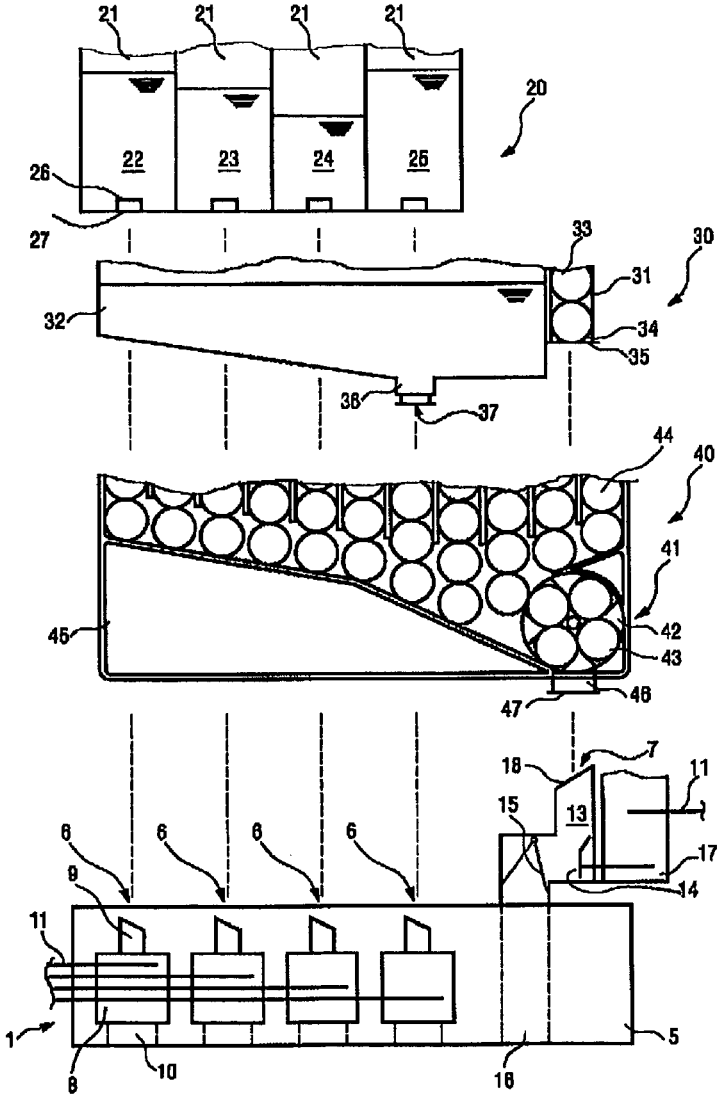
21
21
21
21
20
22
23
24
25
26
27
33
30
31
32
34
35
36
37
44
40
41
45
42
43
47
46
7
18
11
15
13
17
14
6
6
6
6
9
11
1
8
10
16
5

PUSH-IN METERING SYSTEM FOR DOMESTIC APPLIANCES

BACKGROUND OF THE INVENTION

1. Field of the Invention

The present invention relates to dishwashers. More particularly, the present invention relates to domestic dishwasher with an additive dispenser.

The invention relates to a domestic appliance, especially a domestic dishwasher, having a metering device for control of dispensing additive substances, e.g. cleaning and/or rinsing substances, into which a storage insert with additive substances, e.g. cleaning and/or rinsing substances, can be inserted and with the metering device able to dispense additive substances from the storage insert into the treatment compartment, especially the washing compartment.

2. DESCRIPTION OF RELATED ART

Conventional metering systems for washing machines or dishwashers generally have to be loaded manually for each wash process with cleaning substances in liquid, powder or solid form. The necessary quantity of cleaning substances has to be measured in accordance with a selected cleaning program. On the one hand metering the required quantity of detergents using a table to be found on the detergent packaging is inconvenient and brings with it the danger of soiling for the user. On the other hand the metering is susceptible to errors, so that an incorrectly metered amount of detergent can produce an inadequate wash result if the metered amount is too low or impose unnecessary stress on the environment if the amount is too high.

Devices are thus known from the prior art for storing detergent substances for several washing processes within the domestic appliance. Thus for example DE 39 03 636 C2 discloses a dishwasher with a washing compartment and with an automatic dispensing device for liquid detergents, in a separately refillable storage container with a fill level indicator and a dispensing device situated downstream from the receptacle via a detergent outlet being provided for accommodating the detergent. The dispensing device is accessible from the washing compartment side and can be activated for each machine program. The storage container is embodied as a large-volume built-in container and is arranged in a holder unit to allow removal. It can be swung out of the holder unit around a horizontal or vertical support axis to allow filling. Although this device is able to accept detergents for several washing processes it does not however save the operator having to refill the storage container. This can result in pollution, as a result of the spillage of liquid detergent for example. In addition the user of this machine is tied to the use a liquid detergent.

Another device for repeated automatic dispensing of a detergent is known from EP 0 586 633 B1. It comprises a detergent container for powdered detergent with an outlet opening above a dispensing and feed apparatus which is equipped with at least one recess for accommodating individual doses of a powdered detergent. This device too allows the storage of a large volume of washing powder for several washes, but does not do away with the refilling of the storage container with the disadvantages already mentioned above. Even when this metering device is used the user is tied to a specific type of detergent used, powdered detergent in this case.

Finally an exchangeable cassette for detergents is known from WO 02/058528. The cassette is intended for insertion into a corresponding dispensing system. In addition to a storage space for a detergent in pellet form, it comprises a transfer device, with which a pellet can be delivered in each case from the storage space individually to the dispensing device. The transfer device is driven by a drive device in the dispensing system. The cassette cannot be refilled but must be replaced in its entirety. It does save the user the messy operation of refilling a storage container with a detergent substance. However it demands a dispensing system adapted to the cassette with a drive device in the household appliance. This in its turn restricts the user in their choice of manufacturer to the manufacturer of the cassette. In addition the user of this system is once again tied to using a detergent in solid form and cannot operate the domestic appliance with a liquid detergent.

BRIEF SUMMARY OF THE INVENTION

The object of the invention it thus to specify a domestic appliance that on the one hand can accept additive substances for several washes, but on the other hand allows the greatest possible freedom of choice both in respect of the type of detergent and also in respect of the appliance manufacturer. The domestic appliance should also provide the most convenient operation possible. In addition the object of the invention is to specify a corresponding storage insert.

In accordance with its characterizing features, the metering system can be assigned an interface device for interaction with different storage inserts for different types of additive substances, e.g. relating to the form of delivery, especially tabs, powdered or liquid, or relating to the concentration. Preferably the interface device is arranged on the metering device. In a simple embodiment, for each storage insert it can feature a separate connection adapted to the respective use. The metering device is thus not tied to one detergent system but allows the use of different types of additive substances, for example storage inserts for detergents in pellet form, so called minitabs, combinations of tabs and powdered cleaners, combination of tabs and rising agents and finally also the use of a detergent system in which individual components of a detergent are only supplied in the domestic appliance as required in accordance with the program sequence and/or the degree of contamination of the treatment compartment, e.g. washing compartment, or the individual components are combined together to form one detergent liquid, preferably in a microreactor.

With a plurality of different storage inserts the metering unit can likewise feature a plurality of individual connections. According to an advantageous embodiment of the invention the interface device can have at least one connection which can be connected to a delivery opening of different storage inserts in each case. The requirement for this is that the connections of the different storage inserts are standardized at least as regards their arrangement on the storage insert and/or as regards their diameter. This reduces the hardware outlay for the metering device and the space that it occupies in the domestic appliance.

The connections can be embodied separately for liquid and solid additive substances or combined for an alternate operation for liquid additive substances on the one hand and solid substances on the other hand. In accordance with a further advantageous embodiment of the invention the interface device can comprise different connections for liquid and solid additive substances. The metering device is thus configured for handling detergents in liquid and also in solid form, for example as tabs or as powder. In an arrangement of a number of connections the different additive substances can be processed individually or also at the same time.

In accordance with a further advantageous embodiment of the invention the connection for liquid additive substances can comprise a valve. The embodiment of the connection for liquid additive substances as a valve or pump enables the liquid to be metered more precisely, as would have to occur for example in a combined connection for solid and liquid additive substances.

Especially if the additive substances are already present in the storage insert in tablet form portions for a washing process for example, no adaptation of the metering of the detergent to the washing program is undertaken. A further advantageous embodiment of the invention can thus feature a metering device which is able to be controlled via a control device. Depending on the selected cleaning program, the control device can then determine the volume of detergent required for said program. It can react both as a function of the selected washing program and also as a function of the storage insert inserted into the metering device. In particular it can be designed to also control transfer devices already present on the storage insert to initiate the combination of a detergent substance from individual components and if necessary their mixing in a premixing chamber.

So that the metering device can react to the respective requirements of the selected cleaning program depending on the storage insert used, data, especially relating to the additive substances, must be communicated to the metering device. This can be done for example directly by means of a corresponding entry by the user. Or it can occur by transferring data from a data memory provided with the storage inset, e.g. as chips, mechanical or optical devices, which the user inserts into a corresponding reader in the domestic appliance. In accordance with a further advantageous embodiment of the invention the domestic appliance can feature a readout device for data of the storage insert which is able to be activated on insertion of the storage insert into the metering device and which forwards the data to the control of the domestic appliance. The automatic reading out of data which can relate for example to the type of storage insert, the type of the additive substances, for example in respect of the delivery form or the concentration, or the (residual) quantity per storage area in the storage insert, makes it unnecessary for the user to enter data. This excludes a further possible source of errors. In accordance with a further advantageous embodiment of the invention the reader device can read data from a code, a mechanical encoding or from a transponder on the storage insert. These types of reader device only require a small technical outlay and can thus be manufactured at low cost. In particular mechanical encodings can interact directly with a likewise mechanical control which can be operated without the supply of external energy.

In accordance with a further advantageous embodiment of the invention the metering device can be arranged in or on walling, for example a door, a side wall or a roof of the cleaning compartment of the domestic appliance. This type of arrangement guarantees good accessibility and operation which is for example realized by an insertion slot for the storage unit.

An inventive storage insert preferably features at least one first storage area for at least one liquid detergent substance and a second storage area for solid detergents. In addition or as alternatives to detergents pressed into tablet form, powdered additive substances can be accommodated in the storage insert as solid detergents. A storage insert of this type ensures that the metering device can also continue to operate with conventional detergents should prefilled storage inserts not be able to be obtained.

BRIEF DESCRIPTION OF THE DRAWINGS

Further advantages, embodiments and expediencies of the invention will be described in detail in the following with reference to the figure.

FIG. 1 illustrates a dishwasher additive dispenser 1, a cartridge 20, a container 30, and a cassette 40, in accordance with an exemplary embodiment of the present invention.

An inventive storage insert preferably comprises a number of storage areas for individual liquid components of additive substances and if necessary a reactor for mixing different individual components. The principal of the invention will be explained in greater detail below by way of examples which refer to a figure. Said figure shows a metering device 1 into which different storage insert devices can optionally be inserted, namely either a cartridge 20 or a container 30 or a cassette 40. The metering device 1 features an interface device 5 which comprises four connections 6 for liquid additive substances and one connection 7 for detergents in tablet form. Each connection 6 for liquid detergents includes a valve 8. On the side of the valve 8 facing towards the storage insert 20, 30, 40 is arranged a hollow mandrill 9 cut off at an angle. On the side opposite the hollow mandrill 9 the valve 8 has a discharge opening 10 which is connected to a washing area of the domestic appliance not shown in the figure. Via a control line 11 each valve 8 can be controlled separately by a control device not shown.

The connection 7 for solid detergents has a compartment 13 in which a portion of detergent. e.g. a tablet, is stored via a coupling 18 for the next cleaning process. Projecting into the compartment 13 is a pusher 14, which can push the cleaning portion against the resistance of a spring-actuated flap 15 into an outlet passage 16. The outlet passage 16 in its turn is connected to the washing area of the domestic appliance not shown in diagram. The pusher 14 is operated by an actuator 17 which is likewise connected via a control line 11 to the control device. The actuator 17 is additionally equipped with a coupling device not shown, so that, as well as the slider 14 and in coordination with the latter, it can if necessary drive a transfer device of the storage container 40.

The cartridge 40 includes this type of transfer device 41. It features a rotatable compartmented wheel 42, in which a number of compartments 43 are arranged for accommodating detergents in the form of tablets 44. The tablets 44 are arranged in a holder 45 such that they are directed under the force of gravity down onto the compartmented wheel 42. Arranged on the container 45 below the compartmented wheel 42 is an outlet opening 46 which is equipped with a seal 47 against the ingress of moisture.

The metering device 1 is preferably arranged in a slot within a door of the domestic appliance. The slot represents a guide within which the storage insert 20, 30, 40 is pushed to fit precisely onto the connections 6, 7.

The insertion of the cartridge 40 thus pushes the outlet opening 46 onto the coupling 18 of the connection 7, with the coupling 18 piercing the seal 47. At the same time an effective connection is established between the actuator 17 and the transfer device 41 of the cassette 40. During operation of the domestic appliance the control device now activates the actuator 17, so that a tablet 44 is dispensed via the transfer device 41 into the storage compartment 13 and is held ready there for the required metering time within a subsequent process. At the required time the control issues a signal to the actuator 17 via the control line 11, whereupon the actuator 17 moves the tablet 44 by means of the pusher 14 into the outlet passage 16. To do this it pushes the tablet 44 against the flap 15 which prevents the penetration of moisture into the compartment 13, in the transfer device 41 and thus into the cassette 40.

When a cassette 40 is inserted the connections 6 remain inactive for liquid detergents.

As an alternative to the cassette 40 a storage container 30 can also be inserted into the metering device 1. The container 30 has a tablet chamber 31 and a bowl 32. The tablet chamber 31 is filled with tabs 33 and likewise closed off by a seal 35 against moisture at an outlet opening 34. The bowl 32 is used to accommodate a liquid detergent, e.g. a rinsing agent. It features a connecting flange 36 which is likewise closed off by a seal 37 against moisture.

If the container 30 is now inserted via a slot into the metering device 1 the hollow mandrill 9 of the right outer connection 6 pierces the seal 37 on the connecting flange 36. The diameter of the hollow mandrill 9 and of the connecting flange 36 are dimensioned so that a liquid-tight connection between the right outer valve 8 and the bowl 32 is established. The bowl 32 is formed so that the remaining hollow mandrills 9 which are now located to the left of the connection 6 which is now used, cannot touch and thus damage the bowl 32.

At the same time as the seal 37 is opened the coupling 18 pierces the seal 35 and establishes a connection between the compartment 13 and the tablet chamber 31. This means that the first tab 33 already falls into the compartment 13 in front of the pusher 14.

The holder 30 is thus activated for the next and all subsequent cleaning processes. To this end the control device if required issues a signal to the actuator 17, which in the way already described causes tabs 33 to be supplied to a washing compartment not shown here. In addition or as an alternative the control device controls the outermost right-hand valve 8 via the control line 11. The valve 8 subsequently opens at the given time within the cleaning sequence for a predetermined time so that a corresponding volume of liquid detergent can get into the washing compartment from the bowl 32.

The container 30 is supplied with the domestic appliance by the manufacturer. With the container 30 it is possible to also use the detergents currently obtainable in liquid or tablet form in the metering device 1. To this end the container 30 has openings on an upper side of the container 30 not shown in the figure, opposite the connecting flange 36 and the outlet opening 34 with which both the tablet chamber 31 and also the bowl 32 can be refilled. This ensures that the domestic appliance which is equipped with the metering device 1 is fully backwards compatible, since its operation is now no longer dependent on the use of a storage device as a type of cassette 40 or a cartridge 20 explained in greater detail below.

The cartridge 20 represents a storage insert for four liquids separated from each other. As a result it comprises four chambers 21, which each contain basic components 22, 23, 24, 25. Each chamber 21 has a connecting flange 26 which has a liquid-tight seal 27.

If the cartridge 20 is now inserted into the metering device 1, the relevant hollow mandrills 9 of the connections 6 pierce their assigned seals 27 and make a liquid-tight seal against the connecting flanges 26 and the corresponding chambers 21. Depending on the selected washing program the control device now controls the respective valve 8 via the control line 11 such that it is opened for a predetermined time and thus discharges a predetermined volume of agent from the chambers 21 via the discharge opening 10 into the washing compartment of the domestic appliance. In conclusion it is pointed out once again that the metering device and the storage containers described in detail above are only exemplary embodiments and can be modified by the person skilled in the art in different ways, without departing from the field of the invention. In particular the concrete embodiments of the connecting flanges and the hollow mandrills interacting with them can also be in a form other than that described here with the same effect. Likewise the actuator can be embodied at another location or in another form if this is necessary for reasons of space for example.

It is also pointed out for the sake of completeness that the use of the indefinite article "a" or "an" does not exclude the relevant features from being present a number of times.

The invention claimed is:

1. A domestic dishwasher comprising:

a meter including an interface disposed on the meter for interoperating with a storage insert; and a washing compartment for receiving additives dispensed by the meter, wherein the meter is structured to dispense the additives comprising tablets, powders, and liquids, wherein the storage insert is adapted to interoperate with an interface of the meter, the storage insert comprising a plurality of storage areas for liquid additives and solid additives, and wherein one of the storage areas is a storage area for a liquid component of an additive; and the storage insert further comprises a reactor for mixing components of the additive.

2. The dishwasher of claim 1, wherein the interface receives the additives from the storage insert.

3. The dishwasher of claim 1, wherein the interface is adapted to interoperate with separate types of storage inserts each adapted to provide a separate type of additive.

4. The dishwasher of claim 1, wherein the interface device has a connection to which a dispensing opening of different storage inserts can be connected.

5. The dishwasher of claim 1, wherein the interface device includes a separate connection for each of liquid and solid additive substances.

6. The dishwasher of claim 5, wherein said connections for liquid additive substances includes a valve or a pump.

7. The dishwasher of claim 1, wherein the meter is controllable by a controller.

8. The dishwasher of claim 7, further comprising a data reader that activates in response to an insertion of the storage insert into the meter for reading data from the storage insert and for forwarding the data to a controller.

9. The dishwasher of claim 8, wherein the data reader reads the data from one of a code, a mechanical encoding, and a transponder on the storage insert.

10. The dishwasher of claim 1, wherein the meter is on or in a wall of the washing compartment.

11. The dishwasher of claim 1, wherein the interface includes one of mechanical, electrical, and electronic means for interoperating with said storage insert.

* * * * *